US006042433A

United States Patent [19]

Chen

[11] Patent Number: 6,042,433

[45] Date of Patent: Mar. 28, 2000

[54] ELECTRICAL CONTACT

[75] Inventor: Ping Chen, Aichi, Japan

[73] Assignee: The Whitaker Corporation, Wilmington, Del.

[21] Appl. No.: 09/063,867

[22] Filed: Apr. 22, 1998

[30] Foreign Application Priority Data

May 29, 1997 [JP] Japan ..... 9-155729

[51] Int. Cl.[7] ..... H01R 11/22

[52] U.S. Cl. ..... 439/852

[58] Field of Search ..... 439/852, 853, 439/858, 861, 843, 845, 850, 851, 854, 855, 856, 857, 859, 860, 846–849

[56] References Cited

U.S. PATENT DOCUMENTS

| | | | |
|---|---|---|---|
| 4,080,037 | 3/1978 | Kunkle et al. | 439/853 |
| 4,564,259 | 1/1986 | Vandame | 439/852 |
| 5,562,501 | 10/1996 | Kinoshita et al. | 439/852 |

OTHER PUBLICATIONS

Japanese UM Publication No. 5–48371 (JP–Y–5–48371).

*Primary Examiner*—Michael L. Gellner
*Assistant Examiner*—Barry M. L. Standig

[57] ABSTRACT

A small-size electrical contact includes a female contact section allowing for a highly reliable electrical connection with a mating contact. Electrical contact (10) has a female contact section (20), a contact member (30) is arranged inside the female contact section (20). The contact member (30) includes a bent section (31) and a tongue portion (32). The bent section 31 extends from a back end of a second bottom wall (22). Tongue portion (32) connected to the bent section (31) extends toward a front end of the female contact section and has a contact section **(32*a*) facing the second bottom wall (22). In an upper wall (24), a protrusion (40) is provided extending in a direction of the contact member (30) along the tongue portion (32). The protrusion (40) provides support for the contact member (30) when a mating contact (110) is inserted in the female contact section (20)**.

9 Claims, 3 Drawing Sheets

ELECTRICAL CONTACT

FIELD OF THE INVENTION

This invention relates to electrical contacts, especially to female electrical contacts having a female contact section intended for the reception of a mating male contact.

BACKGROUND OF THE INVENTION

An example of a conventional electrical contact of this type can be found in Japanese Utility Model Application No. 93-48371. The electrical contact described therein has a box-shaped female contact section and a conductor-terminating section. A spring-loaded contact member is provided inside the female contact section. The contact member is formed by extending from one wall of the female contact section. At the back end of the contact member, a supporting member is located to support the contact member when the latter forms electrical connection with a mating contact.

However, because of the requirements to further reduce the pitch of electrical contacts arranged inside a housing and to make the housing smaller, it is desirable to reduce the dimensions of the electrical contacts even more. But the design of the above-mentioned female contact section makes it impossible to minimize the dimensions of the contact due to the space needed for the bending of the contact member. Therefore, the purpose of this invention is to offer electrical contacts that are smaller than the conventional contact while providing a reliable electrical connection with mating contacts.

SUMMARY OF THE INVENTION

The electrical contact according to the present invention is fabricated by stamping and forming from a metal sheet a box-shaped female contact section and a terminating section for connection to an electrical wire, the female contact section has a contact member having a bent section extending from one wall near its back end toward an opposite wall and a tongue portion with a tip end facing the opposite wall extending as a nearly straight member toward a front end along the opposite wall at a narrow distance therefrom, and a protrusion is provided in the opposite wall extending toward the contact member at a location coincident with a back end of the tongue portion.

It is desirable to form an extension protruding toward the opposite wall from a tip end of the tongue portion. The extension acts to guide the mating male contact into engagement with a contact section of the tongue portion when the male contact is inserted in the female contact section.

It is also desirable that an opening is provided in the opposite wall of the female contact section to accommodate the extension of the contact member when the contact member is bent. At the back end of the opening, a stop member may be provided to prevent the contact member from excessive bending.

It is further desirable to provide in the female contact section a projection located at a front end of a tip end of the extension. The projection may be formed at a front end of the opening.

An electrical contact comprises a box-shaped female contact section having a bottom wall, an upper wall and side walls, a contact member disposed inside the contact section; wherein the contact member extends from a back end of the bottom wall including a bent section and a tongue portion extending from the bent section along the upper wall toward a front end of the female contact section and toward the bottom wall, and a protrusion extending inwardly from the upper wall toward the front end and along the tongue portion.

BRIEF DESCRIPTION OF THE DRAWINGS

An embodiment of the present invention will now be described by way of example with reference to the accompanying drawings in which.

DETAILED DESCRIPTION OF THE INVENTION

Figure 1:
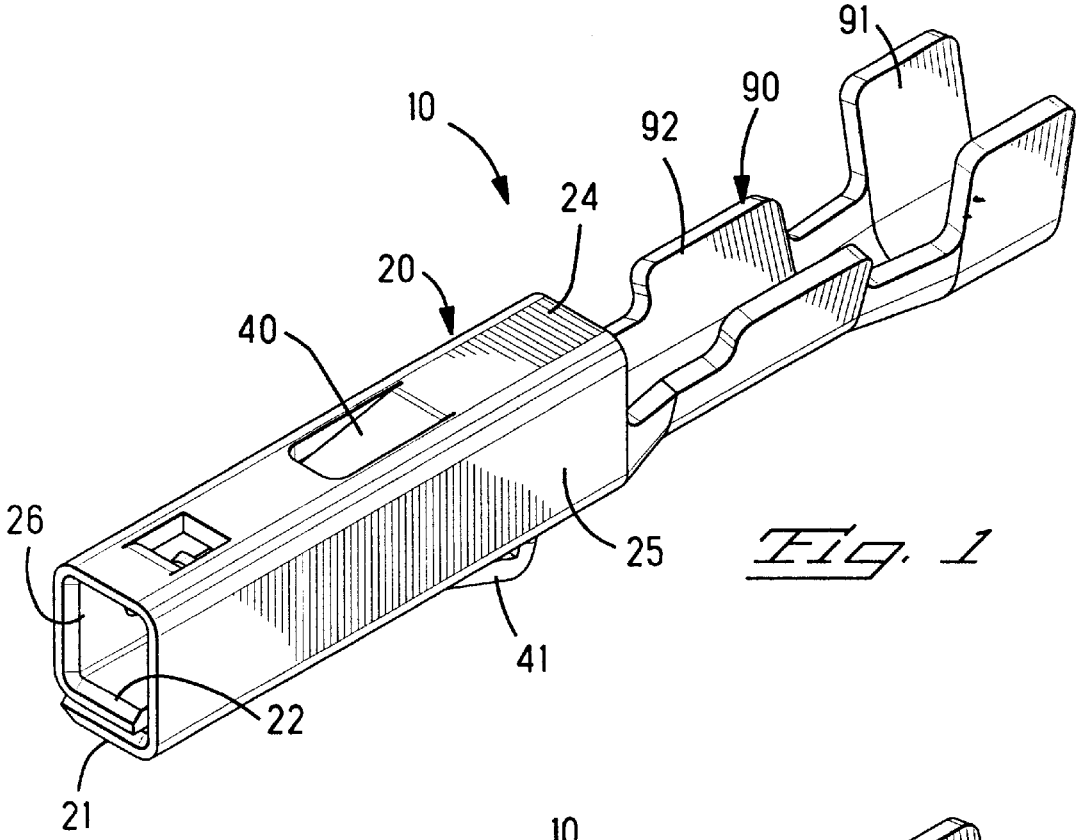
FIG. 1 is a perspective view of an electrical contact according to the present invention.

As can be seen from FIG. 1, electrical contact 10 has a box-shaped female contact section 20 and a conductor-terminating section 90 to which an electrical wire or conductor is connected by crimping. The conductor-terminating section 90 similar to conventional electrical contacts has a conductor-crimping portion 92 and insulation-crimping portion 91. As can be seen from FIGS. 1 and 2, the female contact section 20 includes an upper wall 24, first and second bottom walls 21, 22, and side walls 25, 26. The first bottom wall 21 overlaps the second bottom wall 22.

Figure 2:
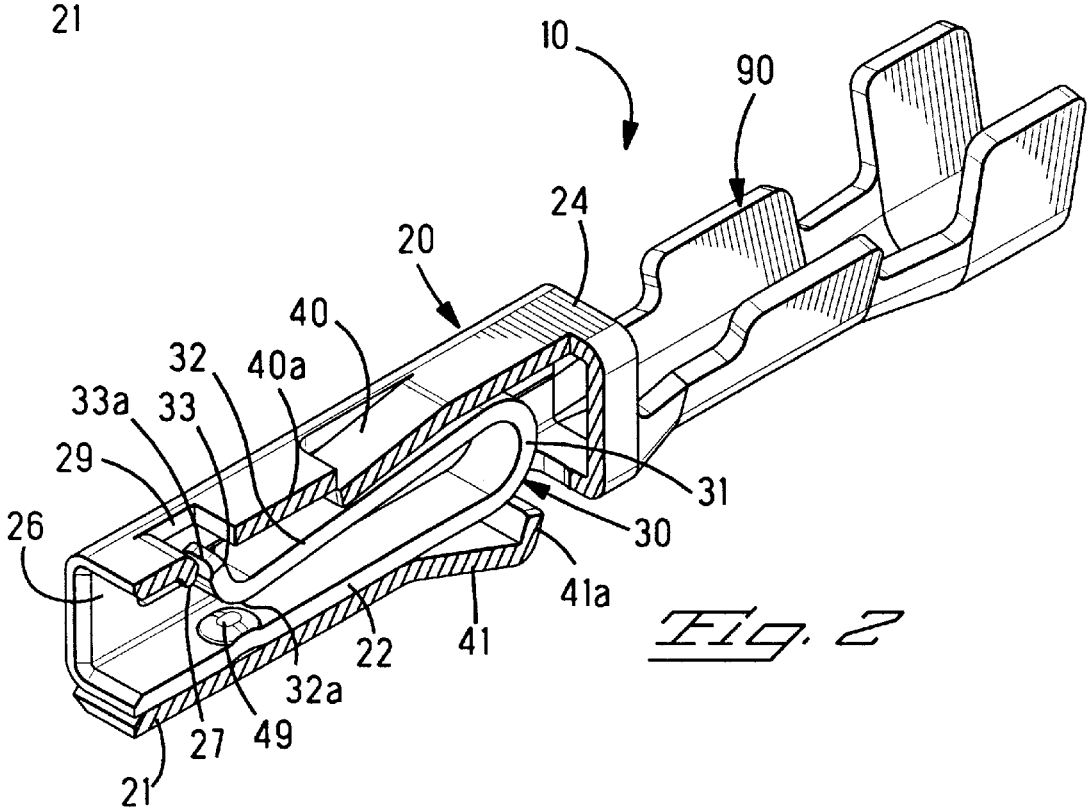
FIG. 2 is a perspective view of the electrical contact shown in FIG. 1 with a female contact section in cross-section.

As can be seen from FIG. 2, a spring-loaded contact member 30 is located inside of the female contact section 20. The contact member 30 originating from a back end of the second bottom wall 22 has a bent section 31 extending toward the upper wall 24 that is opposite the second bottom wall 22 and a linear tongue portion 32 extending forward. A front end of the tongue portion 32 has an extension 33 that is bent toward the upper wall 24. When a mating male contact is received in the female contact section 20, extension 33 guides the male contact toward contact section 32*a* of the tongue portion 32. The upper wall 24 has a protrusion 40 whose location is opposite to the tongue portion 32.

The protrusion 40 is formed by punching out and bending inwardly a portion of the upper wall 24 and is configured as a plate with a free end facing forward. The upper wall 24 has an opening 29 whose position corresponds to the extension 33. The purpose of opening 29 is explained below. In addition, at the front edge of the opening 29, a projection 27 is provided by being bent inwardly so that it overlaps at least a tip end 33*a* of the extension 33. The projection 27 protects the tip end 33*a* of the extension 33 when the mating contact is inserted; it also prevents the contact member 30 from deformation when the tip end 33*a* is engaged by the mating contact pressing against the tip end 33*a*. Also, the second bottom wall 22 has a contact projection 49 having a part-spherical shape located opposite the contact section 32*a*. The first bottom wall has a lance 41 formed therefrom. The purpose of the lance 41 is to secure the electrical contact 10 in a housing cavity (not shown). At a free end of the lance 41, a tab 41*a* is provided. Tab 41*a* is bent inwardly, and it prevents the lance from deformation if a wire becomes entangled in the lance 41.

Figure 3:
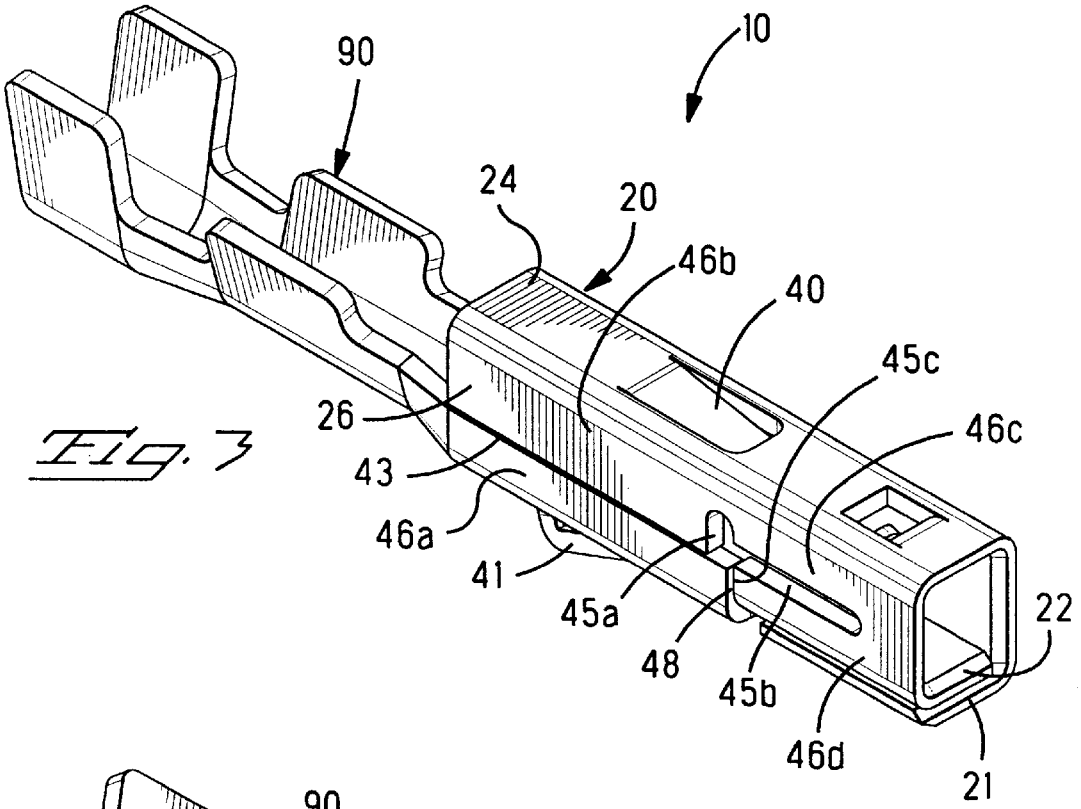
FIG. 3 is a perspective view of the electrical contact shown in FIG. 1 at an angle different from that of FIG. 1.
Figure 4:
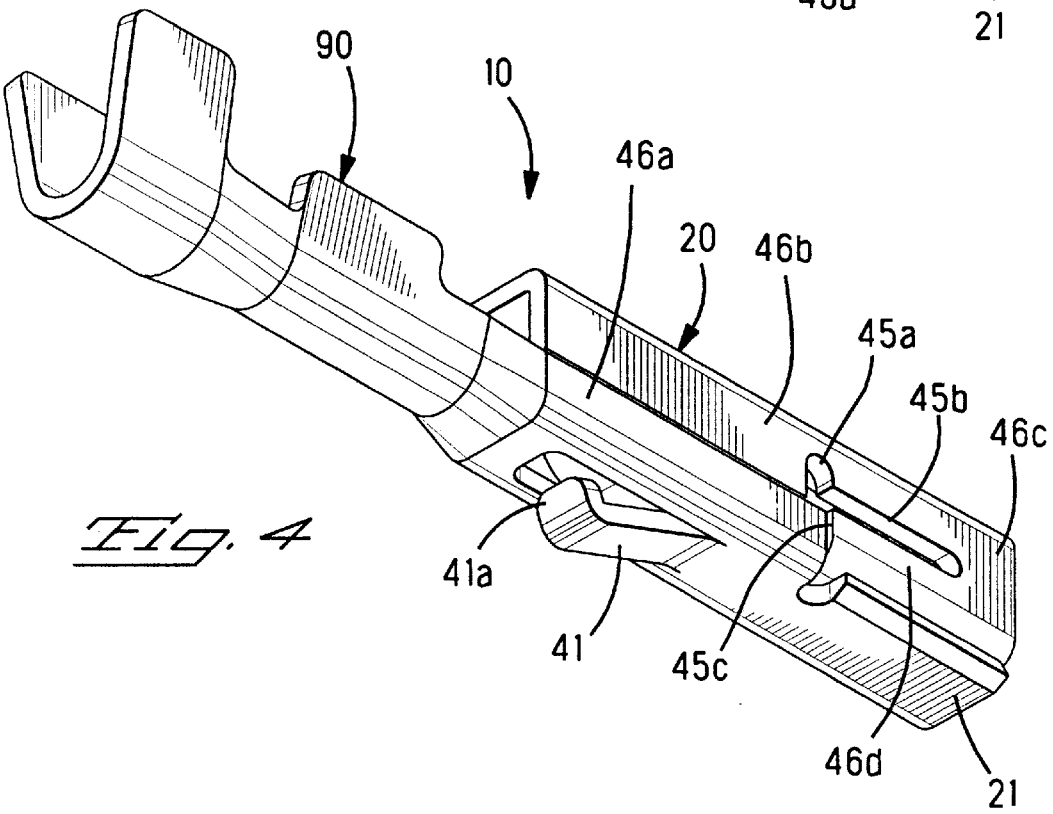
FIG. 4 is a perspective view of the electrical contact shown in FIG. 1 at an angle different from that of FIGS. 1 and 3.

Another important feature of the female contact section 20 is an arrangement preventing the female contact section 20 from wear due to friction which is explained below. As can be seen from FIGS. 3 and 4, the side wall 26 has a first side wall section 46*a*, a second side wall section 46*b*,a third side wall section 46*c* and a fourth side wall section 46*d* defined by a seam 43 and slots 45*a*, 45*b*, 45*c* extending in vertical and longitudinal directions. The first side wall section 46*a* extends from the first bottom wall 21 perpendicularly and abuts the second side wall section 46*b* at the seam 43. The second side wall section 46*b* extends from the upper wall 24 perpendicularly thereto. If necessary, the seam 43 can be welded. The third side wall section 46*c* extends from the upper wall 24 perpendicularly thereto, and its major part is separated from the second side wall section 46*b* by the slot 45*a*. Therefore, the third side wall section 46*c* can be slightly offset relative to the second side wall section 46*b*. A major portion of the fourth side wall section 46*d* is separated from the third side wall section 46*c* by the slot 45*b* connected to or in communication with the slot 45*a*. Therefore, the fourth side wall section 46*d* can be slightly offset relative to the second side wall section 46*b* as well as relative to the first side wall section 46*a* in three directions along axes x, y, z. As mentioned above, the second bottom wall 22 forms a straight inside angle with the fourth side wall section 46*d*, and as mentioned above, the contact member 30 is formed from the second bottom wall 22.

Therefore, when, as described below, a mating male contact is inserted in the space between the contact section 32*a* of the contact member 30 and the contact projection 49, the contact section 32*a* and the contact projection 49 can be displaced in three dimensions, thus eliminating a danger of a poor electrical connection due to wear caused by friction. In addition, the front shoulder 48 of the first side wall section 46*a* can restrict the displacement of the fourth side wall section 46*d*. Slots 45*a*, 45*b* make it possible to observe visually or to check by optical devices the condition of the mating contact inside the electrical contact 10.

Figure 5:
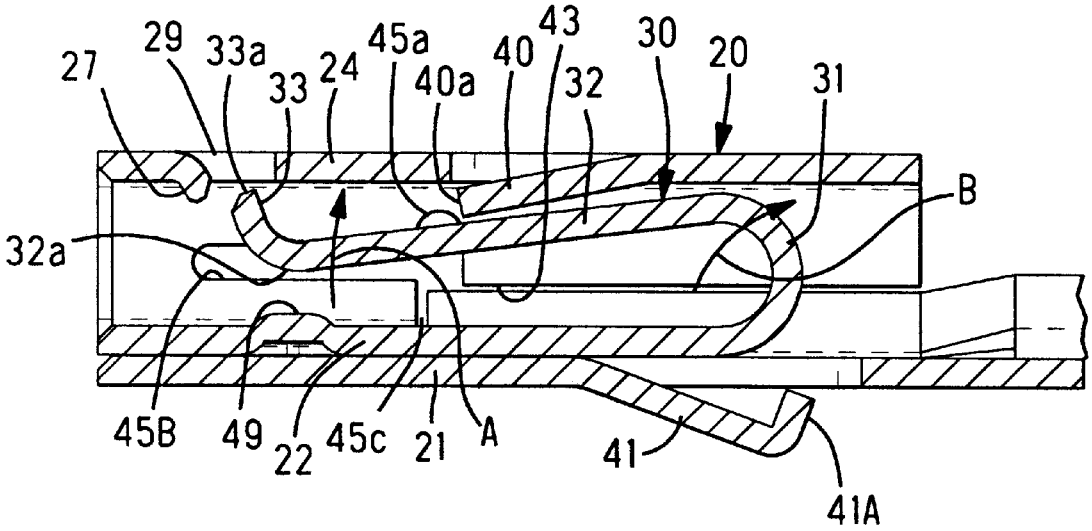
FIG. 5 is a cross-sectional view of the female connect section prior to the insertion of a male mating contact.
Figure 6:
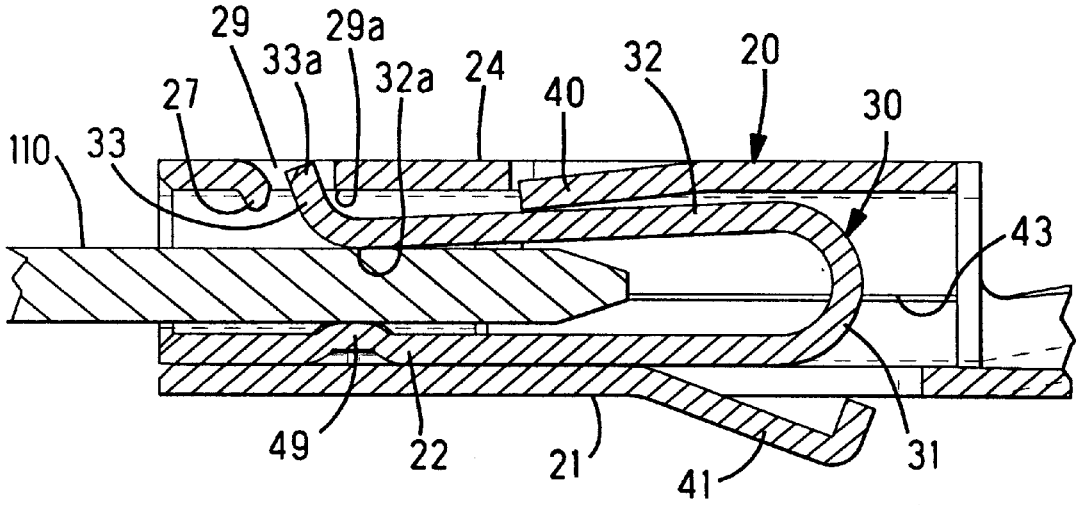
FIG. 6 is a cross-sectional of the female connect section after the insertion of the male mating contact.

FIGS. 5 and 6 illustrate electrical connection between the electrical contact 10 and mating male contact 110. As shown in FIG. 5, before the mating contact 110 is inserted in the female contact section 20, the upper side of the bent section 31 is near but not in engagement with the upper wall 24 and the tongue portion 32 forms a narrow gap with the second bottom wall 22. It should be pointed out that at this time, the tip end 33*a* of the extension 33 is spaced from the projection 27. In this condition, the contact member 30 including the bent section 31 and the tongue portion 32 is located near the protrusion 40 but is not restricted by it.

At the initial moment (not shown) of the insertion of the mating contact 110, the mating contact 110 does not engage the extension 33, and the tongue portion 32 of the contact member 30 is not displaced in an upward direction (shown in FIG. 5 by arrow A) and the bent section 31 is slightly bent in a backward direction (shown in FIG. 5 by arrow B). With the mating contact 110 advancing farther inside the contact section 20, the contact member 30 is displaced in an outward direction. Therefore, the contact member 30 starts to deform the protrusion 40 and its movement begins to be restricted thereby. It should be noted that the bending of the contact member 30 is accompanied by the bending of the bent section 31 and the tongue portion 32.

FIG. 6 shows the condition when the mating contact 110 is fully inserted. At this time, the mating contact 110 is sandwiched between the contact section 32*a* of the contact member 30 and the contact projection 49. The contact member 30 and the protrusion 40 exert sufficient pressure to form an optimum electrical connection with the mating contact 110.

At this time, the extension 33 extends into the opening 29 of the upper wall 24. The opening 29 provides sufficient space for the movement of the contact member 30. As can be seen in the continuous process of insertion represented in FIGS. 5 and 6, in the event of an excessive stress applied to the location near the free end of the tongue portion 32 of the contact member 30 and displacing the spring-loaded contact member 30 upward, the motion of the extension 33 is limited by the edge 29*a* of the opening 29, thus protecting the contact member 30 from deformation. As can be seen from FIG. 6, the contact section 32*a* and the contact projection 49 are located relatively close to the front of the female contact section 20, thereby providing for a relatively long contact area. Another advantage of this feature is that the mating male contact can be made relatively short.

Above, a detailed description of the electrical contact according to this invention has been provided; however, needless to say that various modifications and changes may be made within the scope of this invention. For example, the conductor-terminating section may be made of a compression type, rather than the crimping type, and the upper wall may be narrowed rather than have the protrusion 40.

Since the female contact section of the electrical contact according to this invention has a contact member having a bent section extending from a rear end of one wall in the direction of an opposite wall and a tongue portion having a contact section facing the one wall that extends in a direction of a front end of the contact and toward the one wall so that a gap between a straight portion of the tongue portion and the opposite wall narrows gradually, and that the opposite wall has a protrusion extending toward the tongue portion of the contact member, thereby producing sufficiently high pressure on a mating contact and making it possible to form a highly reliable electrical connection with the mating contact.

I claim:

1. An electrical contact comprising:

a box-shaped female contact section having a front end and a back end and formed by a bottom wall, an upper wall and side walls;

a contact member disposed within the female contact section extending from an inner end of the bottom wall adjacent the back end of the female contact section, the contact member including a bent section extending toward the upper wall and a tongue portion extending from the bent section and along the upper wall toward the front end of the female contact section and toward the bottom wall so that the tongue portion has a slanted orientation; and a protrusion extending inwardly from the upper wall within the female contact section toward the front end of the female contact section and extending along a portion of the tongue portion.

2. An electrical contact as claimed in claim 1, wherein the tongue portion has an extension at a front end thereof extending upwardly toward the upper wall.

3. An electrical contact as claimed in claim 2, wherein the upper wall has an opening to receive the extension.

4. An electrical contact as claimed in claim 3, wherein a projection is located at a front end of the opening.

5. An electrical contact as claimed in claim 4, wherein a contact section is located on the tongue portion adjacent the extension.

6. An electrical contact as claimed in claim 5, wherein the bottom wall has a contact projection opposite the contact section.

7. An electrical contact as claimed in claim 6, wherein the female contact section has another bottom wall overlapping the bottom wall and including a lance member extending outwardly from the another bottom wall.

8. An electrical contact as claimed in claim 3, wherein a back end of the opening acts as a stop member for the tongue portion.

9. An electrical contact as claimed in claim 7, wherein one of the side walls has first, second, third and fourth sections; the first and second sections are disposed opposite each other along a longitudinal seam extending along a back portion of the one of the side walls from the back end of the female contact section to about midway thereof, the third and fourth sections are disposed opposite each other along a longitudinal slot extending along a front portion of the one of the side walls from the longitudinal seam to a position adjacent the front end of the female contact section; and a vertical slot at an inner end of the longitudinal slot in communication with the longitudinal slot.

* * * * *